United States Patent [19]

Etheredge, III

[11] Patent Number: 4,872,263

[45] Date of Patent: Oct. 10, 1989

[54] LUBRICATING DEVICE

[75] Inventor: Robert W. Etheredge, III, Natick, Mass.

[73] Assignee: The Kendall Company, Boston, Mass.

[21] Appl. No.: 252,822

[22] Filed: Sep. 30, 1988

[51] Int. Cl.[4] ..... B26B 19/44

[52] U.S. Cl. ..... 30/41; 83/14; 424/73

[58] Field of Search ..... 30/41, 90; 83/14, 22; 252/132; 424/73, 81; 428/425.8; 525/127

[56] References Cited

U.S. PATENT DOCUMENTS

| | | | |
|---|---|---|---|
| 3,486,225 | 12/1969 | Regan | 30/41 |
| 3,969,817 | 7/1976 | DiBuono | 30/41 |
| 4,170,821 | 10/1979 | Booth | 30/41 |
| 4,314,404 | 2/1982 | Ruiz et al. | 30/41 |
| 4,344,930 | 8/1982 | MacRae et al. | 424/73 X |
| 4,381,293 | 4/1983 | Michel | 424/73 X |
| 4,548,810 | 10/1985 | Zofchak | 424/73 X |

*Primary Examiner*—Douglas D. Watts
*Attorney, Agent, or Firm*—Alvin Isaacs

[57] ABSTRACT

Novel devices for applying a lubricating medium to the skin comprising: (1) a porous matrix impregnated with a lubricating composition consisting essentially of an acid soap of at least one unsaturated higher fatty acid having at least 16 carbon atoms; and (2) a water-insoluble perforated sheet material adhered to one surface of the impregnated porous matrix and through which the lubricating composition can diffuse to the skin when moistened;

and disposable razor blade cartridges containing the same.

29 Claims, 1 Drawing Sheet

LUBRICATING DEVICE

BACKGROUND OF THE INVENTION

The present invention relates to novel devices for applying a lubricating medium to the skin and, more particularly, to disposable razor blade cartridges including such devices.

Various personal care products for imparting lubricity to the skin or hair are well known in the art.

While not intended to be exhaustive of the state of the art, the following patents may nevertheless be taken as exemplary.

U.S. Pat. No. 4,128,631 relates to pre-electric shave skin conditioners and the like containing polymers of 2-acrylamido-2-methylpropane sulfonate to lubricate keratinous substrates such as skin and hair.

U.S. Pat. No. 4,585,650 issued to Newberry et al discloses water-based compositions for lubricating the skin for shaving, which compositions are thin lotions including a mixture of effective amounts of water, a gel former and binding agent, a gelling agent with skin conditioning properties and an emollient.

Of particular interest for a clear understanding of the nature and primary objectives of the present invention, reference is made to U.S. Pat. No. 4,170,821 issued to Booth which relates to a solid water-soluble shaving aid incorporated in a disposable razor blade cartridge. As is disclosed therein, the shaving aid, which will gradually dissolve during the act of wet shaving, is in the form of a lubricant, whisker softener, razor cleaner, medicinal agent, cosmetic agent or combination of the above embedded, dispersed into, formed as an integral component of, or otherwise affixed to the razor blade cartridge structure adjacent the shaving edge or edges of single or multiple razor blades supported therein.

As is discussed in Col. 1 of the Booth patent, in wet-shaving razor systems, there can be experienced a degree of uncomfortableness due to frictional drag of the razor across the skin, the force needed to sever and the mechanical strength of the hair protein structure, clogging of the razor parts with whisker and skin debris and/or the uncomfortableness of shaving nicks and cuts, irritation or pre-existing skin damage or eruptions and uncontrolled bleeding. According to the patentee, various attempts to remedy at least some of these drawbacks have included the use of pre-shave and after-shave lotions, special whisker softening lathers, blood coagulants and other medicinal agents or soothing creams. While shaving comfort can be enhanced, at least to some extent, with one or more of these aids, the requirement that they be applied before and/or after shaving with evaporation or repeated shaving strokes lessening the effectiveness of pre-applied aids and post-shaving application serving only as after-the fact treatment, much is left to be desired in matters of improving shaving comfort.

Accordingly, the patented invention is directed to the task of improving wet shaving, which task is solved by providing for the application of a shaving aid directly to the skin continuously with each stroke of the razor, the shaving aid being a simple inexpensive integral part of a disposable razor blade cartridge which, itself, is disposable along with the cartridge when one or both are spent.

Various embodiments of the shaving aid component of the disposable razor blade cartridge are described and shown in the drawings. In the embodiment of FIG. 1, it is in the form of a strip cemented to the cartridge cap, preferably within a recess provided therefor. The shaving aid strip is disposed in juxtaposition with the blade edges and extended from a point adjacent to one end of the blade to a point similarly adjacent to the opposite end of the blade.

As is stated in the paragraph bridging Cols. 2–3 of the patent, the shaving aid strip may comprise one or more of the following: (a) a lubricating agent for reducing frictional forces; (b) an agent which reduces the drag between the razor parts and the shaver's face; (c) an agent which modifies the chemical structure of the hair so that the blade passes through the whiskers very easily; (d) a cleaning agent allowing the razor parts to be washed more easily; (e) a medicinal agent for killing bacteria or for repairing skin damage and abrasions; (f) a cosmetic agent for softening, smoothing, conditioning or improving the skin; and/or (g) a blood coagulant.

The present invention is directed to modifications of the teachings of the aforementioned U.S. Pat. No. 4,170,821 of Booth to provide a lubricating device for applying a lubricious substance to the skin during repeated usage, which device finds particular usefulness as a shaving aid component of disposable razor blade cartridges of the type illustrated in the above-mentioned patent to provide certain significant improvements to be detailed hereinafter.

BRIEF DESCRIPTION OF THE INVENTION

In accordance with the present invention, the lubricating device will comprise: (1) a porous matrix impregnated with a lubricating composition consisting essentially of an acid soap of at least one unsaturated higher fatty acid having at least 16 carbon atoms; and (2) a water-insoluble perforated sheet material adhered to one surface of the impregnated porous matrix and through which the lubricating composition can diffuse when moistened.

DETAILED DESCRIPTION OF THE INVENTION

Figure 1:
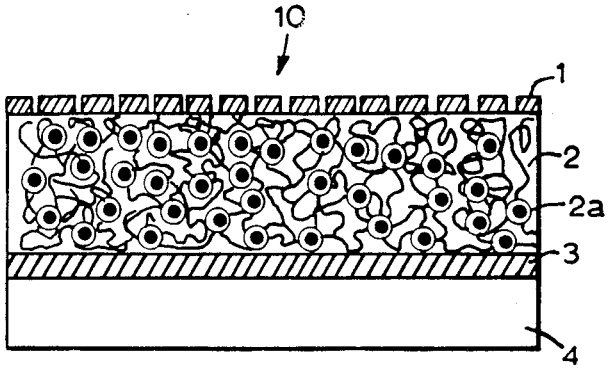
FIG. 1 is a diagrammatic sketch of a novel lubricating device of this invention and FIG. 2 is a perspective view of a conventional disposable razor cartridge having, as a component thereof, the novel lubricating device of this invention.

As was mentioned previously, the present invention relates to novel devices for applying a lubricant to the skin. Since the invention is primarily directed to the use of such lubricating devices as shaving aids in conjunction with per se known disposable razor cartridges, it will accordingly be described in detail hereinafter by reference thereto.

It is well known to employ various shaving aids and compositions for lubricating the skin in an effort to overcome the trauma commonly inflicted on the skin by shaving. One stroke of the razor not only causes hair removal, but skin removal as well. The top layer of the epidermis, the stratum corneum is removed even though it is naturally desquamating. This unnatural stripping of the skin frequently induces local irritation as evidenced by erythema (redness). The degree of irritation is in part dependent upon the skin type, the pressure created by the razor and the type of razor used. People who suffer from skin disorders such as eczema, psoriasis or acne, for example, will experience much more irritation.

The disadvantages of both before and after shave lotions lies with their purpose for use. They are intended to treat the harmful side effects of shaving, not to prevent them. In other words, they focus on the effect and not the cause. [This is sometimes referred to in the medical and scientific fields as the "band-aid" procedure, in contradistinction to preventative treatment.]

An efficacious approach to these problems is the concept disclosed in the aforementioned U.S. Pat. No. 4,170,821 of Booth of providing a lubricant in disposable cartridges which gradually dissolves during the act of wet shaving. The lubricant is provided in the cartridge structure adjacent the razor blade so that lubrication occurs in advance of the blade during shaving.

The patent teachings do nevertheless suffer from certain disadvantages.

For one, with commercially available embodiments of the invention, lubrication has been found to be short lived, lasting on the average of three shaves, whereas the life of the blade itself is longer. Once the life of the lubricating shaving aid is over, its surface becomes irregular and rough and the coefficient of friction increases, thus presenting an additional source of skin irritation. Since the shaving aid is immovably affixed to the cartridge, it will therefore be appreciated that the cartridge is significantly less effective after the three shave life of the shaving aid, even though the razor blade itself may still be usable.

Secondly, the lubricants disclosed in the patent are micro-encapsulated silicone oil, polyethylene oxide in the range of molecular weights from 100,000 to 6,000,000 a non-ionic polyacrylamide or a natural polysaccaride. These lubricants leave a residue which contributes to clogging of the skin pores, thereby impeding normal skin ventilation which in turn can promote ingrown hairs and folliculitis.

Thirdly, the shaving aid as taught in the patent undergoes structural changes with use. When submerged in water in the act of shaving the lubricant is activated and the shaving aid actually diminishes in size as the lubricant diffuses from the shaving aid to the skin. The remaining surface is rough and with continued use itself becomes a skin irritant.

In essence, a primary objective of this invention is to provide improvements in the teachings of the Booth patent so as to obviate the above-noted deficiencies.

A particular objective is to increase the life of the disposable cartridge by increasing the number of times it may be used and still lubricate the skin while shaving.

In accordance with this invention these and other objectives are accomplished by providing a lubricating device comprising a perforated, smooth water-insoluble sheet material secured to one major surface of a porous, water-insoluble matrix material containing or impregnated with an acid soap, e.g. a soap of an unsaturated higher fatty acid containing at least sixteen carbon atoms.

When wetted, for example, in the course of shaving, a portion of the soap will diffuse through the perforations in the overlying perforated sheet so as to contact and thereby lubricate the skin or other substrates in proximal relationship therewith.

For a fuller understanding of the invention reference is now made to the accompanying drawing.

As shown in FIG. 1, the novel lubricating device 10 comprises a perforated sheet 1 and a porous matrix material 2 containing the lubricious acid soap 2*a*. While not an essential component of the invention, the surface of the matrix material 2 opposed from sheet 1 is shown to contain an adhesive layer 3 for laminating the device to a support member or substrate 4 of the article with which it is to be utilized, e.g. a disposable razor cartridge.

Perforated sheet 1 should be as thin as possible, e.g. on the order of about 0.5 to about 1.0 mil thick and will comprise a smooth plastic material, e.g. a polyester such as polyethylene terephthalate, a cellulosic ester such as cellulose acetate, cellulose triacetate, a polyurethane or a polyolefin, e.g. polyethylene or polypropylene.

Matrix 2 comprises a porous material, e.g. an open-celled foam made of polyurethane, ethylene vinylacetate (EVA), plasticized polyvinyl chloride (PVC), etc. and is preferably on the order of from about 50 to about 125 mils thick.

The lubricious acid soap comprises at least an alkaline metal salt, preferably a sodium or potassium salt, of an unsaturated fatty acid having at least 16 carbon atoms. Preferred acids are oleic and linoleic acid, including mixtures thereof.

In the preferred embodiment, the acid salt lubricant will comprise a mixture of the above-mentioned fatty acid salt and an unsaturated higher fatty acid having at least 16 carbon atoms, e.g. in an acid/salt ratio by weight of from about 1:2 to about 2:1. This acid/salt ratio provides aggregation in aqueous environment characterized by layers of very low cohesive strength. In other words, the combination may be thought of as providing a synergestic lowering of cohesion.

As mentioned previously, the present invention is particularly directed to disposable razor blade cartridges having the novel lubricating device of this invention as an integral component part thereof as a shaving aid.

In this context the invention is primarily directed to improvements over the shaving acid-containing razor cartridges disclosed in the aforementioned U.S. Pat. No. 4,170,821.

Figure 2:
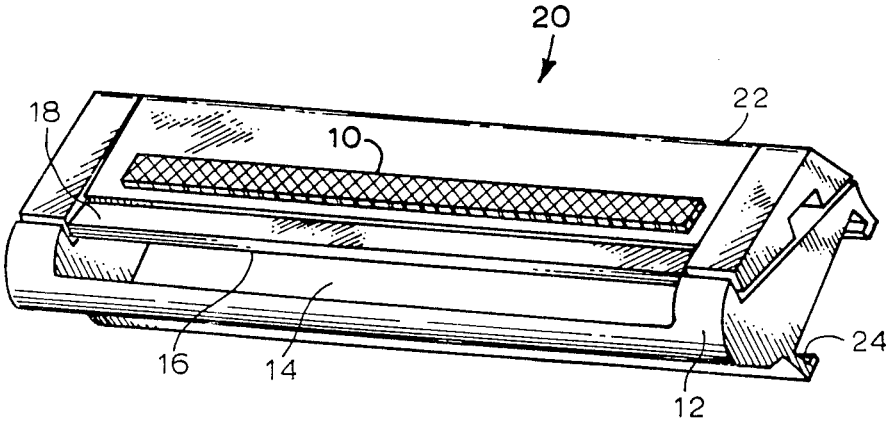

A novel disposable razor cartridge of this description is illustrated in FIG. 2.

As shown therein, a per se known disposable razor cartridge 20 comprises a blade seat 12 having formed thereon a guard bar 14 for smoothening the skin adjacent the cutting edge 16 of a razor blade 18 during shaving. Blade seat 12 further includes a channel 24 which may be used to load cartridge 20 upon a conventional reusable razor main frame (not shown) in the customary manner of sliding a receiving portion of the main frame into channel 24 or sliding channel 24 over the receiving portion of the razor main frame.

Completing the main supporting structure of the razor cartridge 20 and holding blade 18 in place against the seat 12 is cap 22. While cartridge 20 is illustrated in FIG. 2 as being of a single-blade type, it will be appreciated that multiple-bladed cartridges are also contemplated.

In accordance with the present invention, a per se known disposable razor cartridge such as the one of the foregoing description will also contain a lubricating device as previously described and illustrated in FIG. 1 as an integral component thereof.

In the manner described and shown in FIG. 1 of the Booth patent, the novel lubricating device of this invention 10 is adhered, preferably in the form of a strip, to cap 22 of the cartridge, e.g. in a recess provided thereof. The manner of adherence is not critical and may for example be by means of an adhesive layer 3 as shown in FIG. 1, heat sealing, spot welding, or any of the other known methods of joining two substrates including photopolymerization to form an adhesive. In any event, the lubricating component 10 of the cartridge 20 will be disposed in juxtaposition with the edge 16 of razor blade 18 and will extend from a point adjacent one end of the razor blade to a point similarly adjacent to the opposite end of the blade.

As alluded to previously, the present invention provides significant advantages over the teachings of the Booth patent.

Specifically, the following improvements are obtained: (1) the useful life of the cartridge is greatly increased, lubricity during shaving being provided for at least 7–10 shaves due to the fact that the instant lubricant erodes more slowly; (2) the acid soap lubricant of this invention leaves no adverse residue on the skin; (3) the perforated sheet contacting the skin is initially smooth and uniform and, because of its stability, retains its smoothness and shape irrespective of the amount of lubricant which is used up; (4) the smooth perforated sheet has the soothing effect of massaging the skin; and (5) the lubricant-containing matrix is easier to manufacture due to the fact that the matrix material is easier to load with the lubricant than it is to make the solid shaving aid of the patent.

While the invention is primarily directed to providing a lubricant, it will be appreciated that the lubricious vehicle may contain one or more additional reagents performing specific desired functions. For example, it may contain one or more of the reagents recited in the Booth patent, namely an agent which modifies the chemical structure of the hair to allow the razor to pass through the whiskers more easily, e.g. a depilatory agent; a cleaning agent permitting easier washing of the razor after shaving; a medicinal agent such as a bactericide; a cosmetic agent for softening, smoothing, conditioning or improving the skin; or a blood coagulant. Other reagents which may be included, e.g. a scent or perfume, will be readily suggested to the skilled worker.

The method of making the lubricating device of this invention or a razor cartridge containing the device as a component thereof will be readily suggested to the skilled worker in the light of the foregoing description.

By way of illustration, the acid soap lubricant may be introduced into the matrix material as a melt, e.g. at 50° C., and then allowed to cool. Before or after impregnating the matrix with the lubricious vehicle, the perforated top sheet may be heat sealed to the matrix around its periphery. An adhesive, e.g. a pressure-sensitive or heat-sensitive adhesive of known formulation may then, if desired, be applied by conventional coating procedures onto the underside of the matrix, i.e. the surface opposed from the surface adhered to the perforated sheet material. Many variations in the method of manufacture will of course be readily apparent. For example, it is contemplated that the lubricious vehicle may be applied as an emulsion or the adhesive may be coated onto the matrix material prior to impregnation with the lubricious vehicle.

The following Examples show by way of illustration and not by way of limitation the practice of this invention.

EXAMPLE 1

Equal parts by weight of sodium oleate and oleic acid were melted at about 50°–55° C. and the resulting melt was then poured into a 125 mils thick reticulated open-celled polyethylene foam, "Scottfelt", Process Z, Grade 900Z (trademark of Scotfoam, a subsidiary of Knoll International Holding Co.), having approximately 70% porosity. A one-quarter mil "Mylar" (trademark of duPont) perforated sheet was sprayed on one surface thereof with "Photomount" (trademark of 3M) spray adhesive and the sprayed surface was then adhered to one surface of the previously prepared impregnated foam. The perforated sheet had 382±3 perforations, diameter 0.02–0.03", per square inch of surface area.

EXAMPLE 2

Example 1 was repeated, substituting for the foam of Example 1 a reticulated 40 mils medical grade polyurethane foam from Semex Medical, approximately 60% porosity.

EXAMPLE 3

A lubricating device as prepared in Example 1 may then be heat-sealed to a disposable razor cartridge as shown in FIG. 2.

EXAMPLE 4

The coefficient of friction ($\mu$) of a lubricating cartridge as prepared in Example 1("TEST") was compared with that of a cartridge embodying the invention described and claimed in the aforementioned U.S. Pat. No. 4,170,821 and taken from a commercially available "Good News! Plus" Gillette disposable razor cartridge ("CONTROL") utilizing a sled run-Instron testing procedure wherein the TEST and CONTROL devices were run against 398 square millimeters of a polished steel surface under a load (pressure) of 1032 grams at speeds of 5, 10 and 50 inches per minute.

The respective coefficients of friction ($\mu$) with ± deviation limits in per cent under dry or wet conditions are set forth in the following Table.

TABLE

| DEVICE | SPEED | $\mu$ | + Dev. (%) | CONDITION |
|---|---|---|---|---|
| CONTROL | 5"/min | 0.13 | — | Dry |
| CONTROL | 5"/min | 0.17 | 0.03 | Wet ($H_2O$) |
| CONTROL | 10"/min | 0.14 | 0.03 | Wet ($H_2O$) |
| CONTROL | 50"/min | 0.15 | 0.04 | Wet ($H_2O$) |
| TEST | 5"/min | >5 | — | Dry |
| TEST | 5"/min | 0.08 | 0.02 | Wet ($H_2O$) |
| TEST | 10"/min | 0.08 | 0.03 | Wet ($H_2O$) |
| TEST | 50"/min | 0.06 | 0.01 | Wet ($H_2O$) |

As will be seen, when the TEST cartridge was utilized under "wet" conditions as would be present when shaving, the coefficient of friction was substantially lower on the average of 50% at the various speeds such as one might employ when shaving.

While the present invention is primarily directed to disposable razor cartridges and has been described in detail by reference thereto, it will be appreciated that the present invention is also useful in other procedures for applying a lubricant to the skin or other substrate.

Since certain changes may be made without departing from the scope of the invention herein involved, it is intended that all matter contained in the above description and shown in the accompanying drawing shall be interpreted as illustrative and not in a limiting sense.

What is claimed is:

1. A lubricating device comprising: (1) a porous matrix impregnated with a lubricating composition consisting essentially of an acid soap of at least one unsaturated higher fatty acid having at least 16 carbon atoms; and (2) a water-insoluble perforated sheet material adhered to one surface of said impregnated porous matrix and through which said lubricating composition can diffuse when moistened.

2. A lubricating device as defined in claim 1 wherein said lubricant comprises a mixture of said fatty acid soap and an unsaturated higher fatty acid having at least 16 carbon atoms.

3. A lubricating device as defined in claim 2 wherein said soap comprises an alkaline metal salt of oleic or linoleic acid.

4. A lubricating device as defined in claim 3 wherein said fatty acid in said mixture comprises oleic or linoleic acid.

5. A lubricating device as defined in claim 2 wherein the ratio by weight of said soap to said acid is from about 1:2 to about 2:1.

6. A lubricating device as defined in claim 4 wherein the ratio by weight of fatty acid soap to fatty acid is about 1:1.

7. A lubricating device as defined in claim 1 wherein said porous matrix comprises an open-celled foam.

8. A lubricating device as defined in claim 7 wherein said foam is from about 50 to about 125 mils thick.

9. A lubricating device as defined in claim 1 including an adhesive layer on the surface of said impregnated porous matrix opposed from said perforated sheet material.

10. A lubricating device as defined in claim 9 including a support member laminated to said adhesive layer.

11. A lubricating device as defined in claim 10 wherein said support member is the cap of a disposable razor cartridge.

12. A lubricating device comprising: (1) an open-celled foam impregnated with a lubricating composition comprising a mixture of (a) an alkaline metal salt of unsaturated fatty acid containing at least 16 carbon atoms and (b) unsaturated fatty acid containing at least 16 carbon atoms; and (2) a water-insoluble perforated sheet material adhered to one surface of said impregnated open-celled foam.

13. A lubricating device as defined in claim 12 wherein said salt comprises an alkaline metal salt of oleic or linoleic acid and said acid comprises oleic or linoleic acid.

14. A lubricating device as defined in claim 13 wherein the ratio by weight of said salt to said acid is from about 1:2 to about 2:1.

15. A lubricating device as defined in claim 13 wherein the ratio by weight of said salt to said acid about 1:1.

16. A lubricating device as defined in claim 13 including a layer of adhesive on the surface of said impregnated open-celled foam opposed from said perforated sheet material.

17. A disposable razor cartridge comprising:
a blade seat;
a razor blade;
a cap; and
a lubricating device
secured to said cartridge in juxtaposition with said razor blade, said lubricating device comprising (1) a porous matrix impregnated with a lubricating composition consisting essentially of an acid soap of at least one unsaturated higher fatty acid having at least 16 carbon atoms; and (2) a water-insoluble perforated sheet material adhered to one surface of said impregnated porous matrix and through which said lubricating composition can diffuse when moistened.

18. A razor cartridge as defined in claim 17 wherein said lubricant comprises a mixture of said fatty acid soap and an unsaturated higher fatty acid having at least 16 carbon atoms.

19. A razor cartridge as defined in claim 18 wherein said soap comprises an alkaline metal salt of oleic or linoleic acid.

20. A lubricating device as defined in claim 19 wherein said fatty acid in said mixture comprises oleic or linoleic acid.

21. A razor cartridge as defined in claim 18 wherein the ratio by weight of said soap to said acid is from about 1:2 to about 2:1.

22. A razor cartridge as defined in claim 20 wherein the ratio by weight of fatty acid soap to fatty acid is about 1:1.

23. A razor cartridge as defined in claim 17 wherein said porous matrix comprises an open-celled foam.

24. A razor cartridge as defined in claim 23 wherein said foam is from about 50 to about 125 mils thick.

25. A razor cartridge as defined in claim 17 wherein said lubricating device is secured to the cap of said cartridge by means of a layer of adhesive.

26. A disposable razor cartridge comprising:
a blade seat;
a razor blade;
a cap; and
a lubricating device secured to said cartridge in juxtaposition with said razor blade, said lubricating device comprising: (1) an open-celled foam impregnated with a lubricating composition comprising a mixture of (a) an alkaline metal salt of unsaturated fatty acid containing at least 16 carbon atoms and (b) unsaturated fatty acid containing at least 16 carbon atoms; and (2) a water-insoluble perforated sheet material adhered to one surface of said impregnated open-celled foam.

27. A razor cartridge as defined in claim 26 wherein said salt comprises an alkaline metal salt of oleic or linoleic acid and said acid comprises oleic or linoleic acid.

28. A razor cartridge as defined in claim 27 wherein the ratio by weight of said salt to said acid is from about 1:2 to about 2:1.

29. A razor cartridge as defined in claim 28 wherein the ratio by weight of said salt to said acid is about 1:1.

* * * * *

UNITED STATES PATENT AND TRADEMARK OFFICE

CERTIFICATE OF CORRECTION

PATENT NO. : 4,872,263

DATED : 10/10/1989

INVENTOR(S) : Robert W. Etheredge, III

It is certified that error appears in the above—identified patent and that said Letters Patent is hereby corrected as shown below:

On the title page:

[75] Inventors: Robert W. Etheredge, III, Natick, MA

John C. Charkoudian, Carlisle, MA

Signed and Sealed this

Twentieth Day of November, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,872,263

DATED : October 10, 1989

INVENTOR(S) : Etheredge, III

It is certified that error appears in the above-identified patent and that said Letters Patent is hereby corrected as shown below:

The title page should be deleted to appear as per attached page.

Signed and Sealed this

Sixth Day of October, 1992

*Attest:*

DOUGLAS B. COMER

*Attesting Officer*

*Acting Commissioner of Patents and Trademarks*

United States Patent [19]

Etheredge, III

[11] Patent Number: 4,872,263

[45] Date of Patent: Oct. 10, 1989

[54] LUBRICATING DEVICE

[75] Inventor: Robert W. Etheredge, III, Natick; John C. Charkoudian, Carlisle, both of Mass.

[73] Assignee: The Kendall Company, Boston, Mass.

[21] Appl. No.: 252,822

[22] Filed: Sep. 30, 1988

[51] Int. Cl.[4] ..... B26B 19/44

[52] U.S. Cl. ..... 30/41; 83/14; 424/73

[58] Field of Search ..... 30/41, 90; 83/14, 22; 252/132; 424/73, 81; 428/425.8; 525/127

[56] References Cited

U.S. PATENT DOCUMENTS

| | | | |
|---|---|---|---|
| 3,486,225 | 12/1969 | Regan | 30/41 |
| 3,969,817 | 7/1976 | DiBuono | 30/41 |
| 4,170,821 | 10/1979 | Booth | 30/41 |
| 4,314,404 | 2/1982 | Ruiz et al. | 30/41 |
| 4,344,930 | 8/1982 | MacRae et al. | 424/73 X |
| 4,381,293 | 4/1983 | Michel | 424/73 X |
| 4,548,810 | 10/1985 | Zofchak | 424/73 X |

*Primary Examiner*—Douglas D. Watts
*Attorney, Agent, or Firm*—Alvin Isaacs

[57] ABSTRACT

Novel devices for applying a lubricating medium to the skin comprising: (1) a porous matrix impregnated with a lubricating composition consisting essentially of an acid soap of at least one unsaturated higher fatty acid having at least 16 carbon atoms; and (2) a water-insoluble perforated sheet material adhered to one surface of the impregnated porous matrix and through which the lubricating composition can diffuse to the skin when moistened;

and disposable razor blade cartridges containing the same.

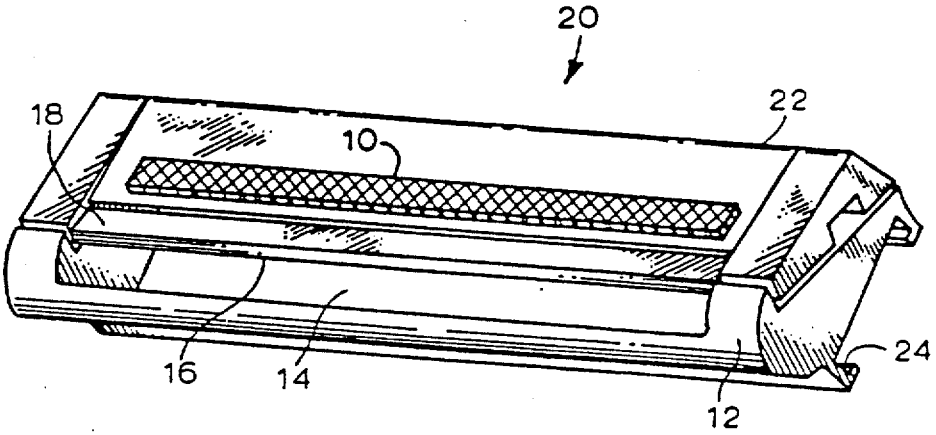

29 Claims, 1 Drawing Sheet